United States Patent [19]

Suga

[11] 4,075,529

[45] * Feb. 21, 1978

[54] XENON LAMP CONTAINING MAGNETIC ADSORBERS INSIDE THE TUBE THEREOF

[76] Inventor: Shigeru Suga, Yoyogi 5-20-2, Shibuya, Tokyo, Japan

[ * ] Notice: The portion of the term of this patent subsequent to Nov. 9, 1993, has been disclaimed.

[21] Appl. No.: 779,225

[22] Filed: Mar. 18, 1977

[51] Int. Cl.[2] ..... H01J 1/50; H01J 61/16

[52] U.S. Cl. ..... 313/154; 313/161; 313/224

[58] Field of Search ..... 313/153, 161, 224, 154

[56] References Cited

U.S. PATENT DOCUMENTS

| | | | |
|---|---|---|---|
| Re. 27,443 | 7/1972 | Kyp | 313/153 X |
| 2,410,054 | 10/1946 | Fremlin et al. | 313/155 X |
| 3,881,132 | 5/1975 | Miller | 313/161 X |
| 3,991,336 | 11/1976 | Suga | 313/161 X |

*Primary Examiner*—Palmer C. Demeo
*Attorney, Agent, or Firm*—Wenderoth, Lind & Ponack

[57] ABSTRACT

A xenon lamp containing magnet adsorbers, each of the magnet adsorbers having pieces of magnetic material which are dispersed in a ring-shaped, heat-resisting, electric insulating plate and being mounted between the discharge portion of an electrode inside the tube of the xenon lamp and the sealed portion of the electrode at an end of the tube, whereby the metallic vapor and other volatilized matters resulting from the elevated temperature of the electrode during discharge are adsorbed by the adsorber due to the magnetic field of the latter and do not adhere to the inside of the tube to thereby prevent blackening, devitrification and white-turbidity of the tube.

5 Claims, 6 Drawing Figures

XENON LAMP CONTAINING MAGNETIC ADSORBERS INSIDE THE TUBE THEREOF

The present invention relates to a xenon lamp, and more particularly to a xenon lamp having magnetic adsorbers therein for preventing blackening and like effects in the tube of the lamp.

BACKGROUND OF THE INVENTION AND PRIOR ART

As illustrated in FIG. 1, conventional xenon lamps generally have a construction in which electrodes 1 and 1' such as thoriated tungsten electrodes are sealed in the ends of a quartz glass tube 2, the inside of which is charged with xenon gas, and the electrodes are connected to an electric circuit for causing a discharge through the xenon for causing the emission of light. Upon discharge, the electrodes are heated and the temperature of the tip ends thereof becomes high, causing a small quantity of the metal of the electrodes to evaporate and then condense on and adhere throughout the inside of the tube 2. This deposit blackens the tube. The blackened tube adsorbs light and the quantity of transmitted light decreases. For example, it has been found that after a lighting period of 100 hours, the quantity of light emitted from the tube decreases by about 10% to 30%. Consequently, if a xenon lamp having such a construction is used as a light source in a light fastness tester which requires a stable or constant quantity of light, correct test results cannot be obtained.

As means for preventing this blackening, there has been proposed an arrangement in which a ring magnet is provided around the outside of the tube of the xenon lamp near the electrodes, as in U.S. Pat. No. 3,991,336 entitled "Magnetized xenon lamp". This arrangement is indeed effective to prevent the occurrence of blackening in the portion of the tube from which most of the light is emitted, but it is disadvantageous in that the tube wall near the ring-shaped magnet blackens to an extreme degree and eventually becomes whitely turbid and devitrified, thus becoming liable to undergo fissure and breakage.

OBJECT AND BRIEF SUMMARY OF THE INVENTION

It is the object of the present invention to provide a magnetic adsorber arrangement which overcomes this problems. According to the present device, a magnetic adsorber is mounted on the inside of the tube around the electrode of a xenon lap and between the tip of the electrode and the end of the electrode sealed into the end of the tube of the xenon lamp. The adsorber is comprised of magnetic pieces which are disposed in a ring-shape plate of heat-resisting, electric insulating material. Metallic vapor and other volatilized matter are attached to the magnetic adsorber, and only the adsorber blackens, so that blackening, devitrification and white-turbidity of the inside of the tube is prevented and a constant quantity of light without reduction in the quantity of light is ensured even after lighting over a long period, and no damage to the tube is caused.

BRIEF DESCRIPTION OF THE DRAWINGS

The invention will now be described in greater detail in connection with the accompanying drawings in which.

DETAILED DESCRIPTION OF THE INVENTION

Figure 1:
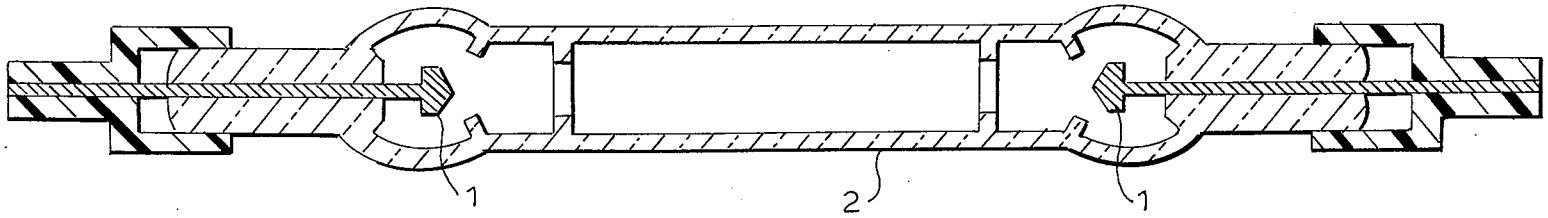
(PRIOR ART) FIG. 1
FIG. 1 is a longitudinal section of a conventional xenon lamp.
Figure 2:
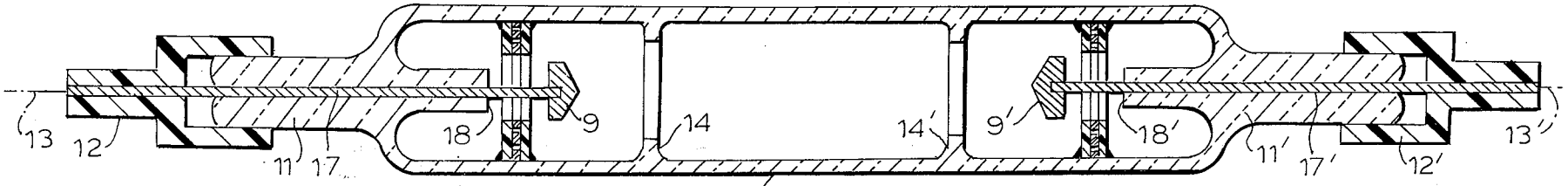
FIG. 2 is a longitudinal section of a xenon lamp containing magnetic adsorbers according to the present invention.

As shown in FIG. 2, the xenon lamp has electrodes 9 and 9' in opposite ends of a quartz tube 10 at electrode sealing portions 11 and 11'. Tube holders 12 and 12' hold the sealing portions and the electrodes are connected to an electric circuit by conductors 13 and 13' which extend through the holders 12 and 12'. Ring-shaped projections 14 and 14' are provided around the inside of the tube.

Adsorbers 8 and 8' comprising magnetic pieces inlaid in a ring-shaped plate made of a heat-resisting, electric insulating material (e.g. ceramic or quartz) are mounted on the inside of tube 10 around the electrodes 9 and 9'.

Figure 5:
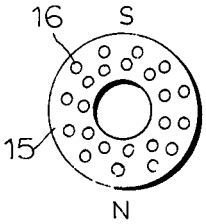
FIG. 5 is a front elevation view showing the shape of the adsorber.
Figure 6:
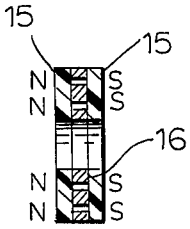
FIG. 6 is a side elevation view showing the shape of the adsorber.

As illustrated in FIGS. 5 and 6, each of the adsorbers 8 and 8' comprise small iron pieces 16 dispersed between two perforated, ring-shaped disks 15 and 15' made of a heat-resisting, insulating material, and the peripheries of the disks 15 and 15' are joned together, e.g. by welding. The iron pieces 16 are magnetized so that, as shown in FIG. 5, the N-S polarity is in the diametral direction or, as shown in FIG. 6, it is in the direction of the thickness of the adsorber. The adsorber is held in the tube 10 by welding or the like to the inside of the tube. The adsorber should have a constructon such that the iron pieces after magnetization will not move and contact each other. To this end, for example, indentations can be formed in the disk 15 corresponding to the number of iron pieces and the iron pieces can be held therein.

Figure 3:
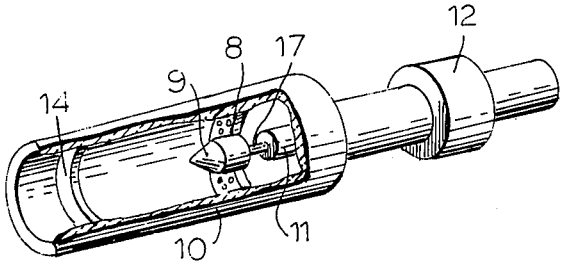
FIG. 3 is a partial cutaway view of the tube of the lamp of FIG. 2 showing the external appearance of the electrode portion and the adsorber.
Figure 4:
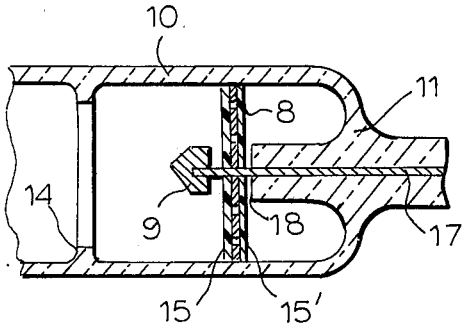
FIG. 4 is a sectional view, on an enlarged scale, of the electrode portion of FIG. 3.

In FIGS. 3 and 4, the sealing portion 11 extends into the tube 10 to a point 18, and a linear or ribbon-like electrode bar 17 sealed in the sealing portion 11 projects from the end of the tube 10. The electrode 9 is fixed on the tip end of the electrode bar 17 inside the tube.

Between the electrode 9 and point 18 is mounted the adsorber 8, with the space between electrode 9 and spacer 18 being somewhat larger than the thickness of the adsorber.

Upon discharge of the lamp, an electric current flows and the temperature of the electrodes rises, causing evaporation of a small amount of material from the electrodes. The metal thus evaporated from the electrodes and ionized is acted on by the magnetic force due to the magnetic field of the magnetic pieces of the adsorbers 8 and 8' and so cannot move freely. It is attracted to and adheres to the adsorbers without impinging upon the tube portion 10. Since the magnetic pieces are dispersed, the metallic vapor adheres to the whole area of the adsorber and does not adhere to the tube wall portion 10 from which light to be utilized is emitted and so that tube portion does not become black. Moreover, the tube portion around the electrodes undergoes neither devitrification nor white-turbidity. Consequently, it is possible to obtain a constant quantity of light over a light period. As a result of a test, it has been found that after a lighting period of 1,500 hours the decrease in the quantity of light due to blackening, etc. is less than 10% and that as compared with a conventional xenon lamp, that is, a 10% to 30% reduction after lighting for 100 hours and about 40% reduction after 1,000 hours, the present device is extremely effective.

What is claimed is:

1. A xenon lamp comprising a transparent tube, and electrode structure at each end of said tube including an electrode extending into said tube and sealing said electrode into the end of said tube, and an annular magnetic absorber around each electrode structure and mounted on the inner surface of said tube between the free end of the electrode within the tube and the end of the tube in which the electrode is sealed.

2. A xenon lamp as claimed in claim 1 in which said electrode construction comprises a portion of said tube extending into said end of said tube, a conductor extending from outside said tube through said portion into the interior of said tube and an electrode on the free end of said conductor and spaced from the end of said portion of said tube, and said annular magnetic adsorber being between said electrode and said end of said portion of said tube.

3. A xenon lamp as claimed in claim 1 in which each annular magnetic adsorber comprises a pair of annular discs of a heat resisting, electric insulating material and a plurality of small pieces of magnetic material held in fixed positions therebetween.

4. A xenon lamp as claimed in claim 3 in which said pieces of magnetic material are oriented with the one poles in one diametral direction and the other poles in the other diametral direction.

5. A xenon lamp as claimed in claim 3 in which said pieces of magnetic material are oriented with the one poles toward one disc and the other poles toward the other disc.

* * * * *